US006797322B2

(12) United States Patent
Tullos

(10) Patent No.: US 6,797,322 B2
(45) Date of Patent: Sep. 28, 2004

(54) METHOD OF REDUCING SURFACE DEFECTS IN A POWDER COATED SURFACE

(75) Inventor: Gordon L. Tullos, Reading, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 10/303,508

(22) Filed: Nov. 25, 2002

(65) Prior Publication Data

US 2003/0104128 A1 Jun. 5, 2003

Related U.S. Application Data

(60) Provisional application No. 60/338,387, filed on Dec. 4, 2001.

(51) Int. Cl.[7] ..... B05D 3/12; B05D 1/12

(52) U.S. Cl. ..... 427/195; 427/475; 427/485; 427/275; 427/325

(58) Field of Search ..... 427/475, 485, 427/195, 201, 275, 325, 471, 477

(56) References Cited

U.S. PATENT DOCUMENTS

D266,720 S * 11/1982 Moore et al. ..... D6/192
5,824,373 A 10/1998 Biller et al. ..... 427/474
5,882,730 A 3/1999 Kimura et al. ..... 427/271
6,136,370 A * 10/2000 Muthiah et al. ..... 427/189
6,268,022 B1 * 7/2001 Schlegel et al. ..... 427/471

FOREIGN PATENT DOCUMENTS

EP 933 140 * 8/1999
GB 2273 718 A 6/1994

* cited by examiner

*Primary Examiner*—Fred J. Parker
(74) *Attorney, Agent, or Firm*—Andrew E. C. Merriam

(57) ABSTRACT

A method of reducing the formation of surface defects in a coated substrate includes providing coating powders at both the appearance surfaces and the non-appearance surfaces of the substrate. A method of coating a substrate includes machining the appearance surface of the substrate, machining the non-appearance surface of the substrate, disposing a first powder at the appearance surface of the substrate, and disposing a second powder at the non-appearance surface of the substrate. The powders are disposed at the surfaces by electrostatic deposition. A method of facilitating the adherence of a coating at an edge between two surfaces of a substrate includes configuring the edge to have a rounded surface.

10 Claims, 2 Drawing Sheets

METHOD OF REDUCING SURFACE DEFECTS IN A POWDER COATED SURFACE

CROSS REFERENCE TO RELATED PATENT APPLICATIONS

This is a non-provisional application of prior pending U.S. provisional application Ser. No. 60/338,387 filed Dec. 4, 2001.

BACKGROUND

This disclosure relates generally to the reduction of defects in the appearance surfaces of a powder coated substrate.

Coating powders are dry, finely divided, free flowing, solid materials at room temperature. Upon application to a surface, they are heated to fuse and optionally cure, thereby forming an even, uniform coating. In many surface-finishing applications, only the appearance surface of substrate is coated. During the curing cycle moisture is driven from the core of the substrate to the outer surfaces thereof, where it evaporates, ultimately causing the substrate to shrink. Where the substrate is fabricated from a hygroscopic material, over time moisture is absorbed through the non-coated non-appearance surface, ultimately causing the substrate to expand. Upon expansion of the substrate, the substrate may become warped and the coating may be stressed, oftentimes to the point at which interruptions occur in the continuity of the coating, thereby resulting in the formation of blemishes, cracks, or other surface defects.

One approach to reducing defects in a powder coated appearance surface having edges, corners, profiles, or other discontinuities involves the machining of grooves, channels, or holes into the non-coated non-appearance surface of the substrate (the surface opposing the appearance surface). The machining of such grooves, channels, or holes facilitates the out-gassing of volatiles from the substrate through the non-appearance surface by providing sufficient pathways for the volatile components to escape. While allowing the escape of volatiles through the non-appearance surface oftentimes reduces cracking of a coating applied to the appearance surface, the absorption of moisture through the nonappearance surface may be sufficient to cause the substrate material to expand and warp, which may subsequently lead to the stressing of the coating.

Accordingly, there exists a need for methods to reduce surface defects in the powder coating, particularly for surfaces where the absorption of moisture causes the substrate to expand and stress the coating.

SUMMARY

In one aspect, a method of reducing the formation of surface defects in a coated substrate includes providing coating powders at both the appearance surfaces and the non-appearance surfaces of the substrate.

In another aspect, a method of coating the substrate includes disposing a first powder at the appearance surface of the substrate, and disposing a second powder at the non-appearance surface of the substrate. A method of facilitating the adherence of a coating at an edge between two surfaces of the substrate includes configuring the edge to have a rounded surface.

BRIEF DESCRIPTION OF THE DRAWINGS

Referring now to the drawings, which are meant to be exemplary and not limiting, and wherein like elements are numbered alike in the several FIGURES.

DETAILED DESCRIPTION

Figure 1:
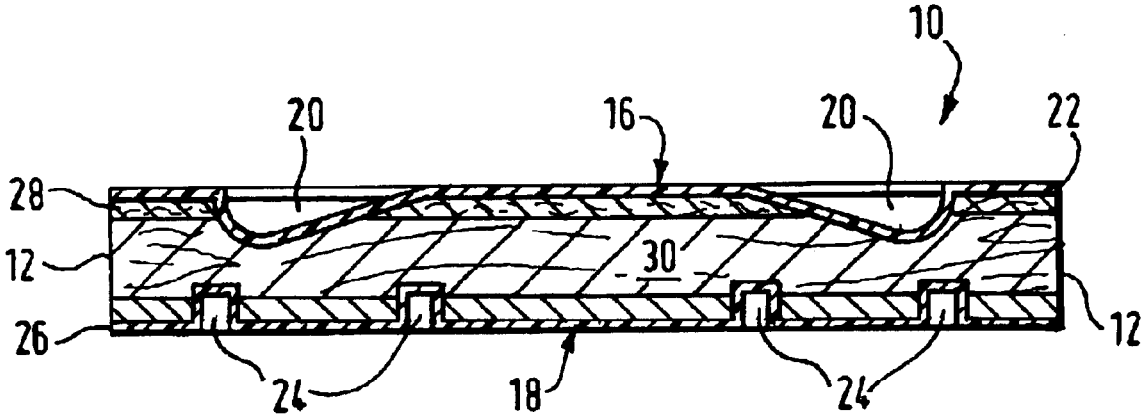
FIG. 1 is a sectional view of a substrate having coatings disposed on the appearance surface and on the non-appearance surface thereof.
Figure 2:
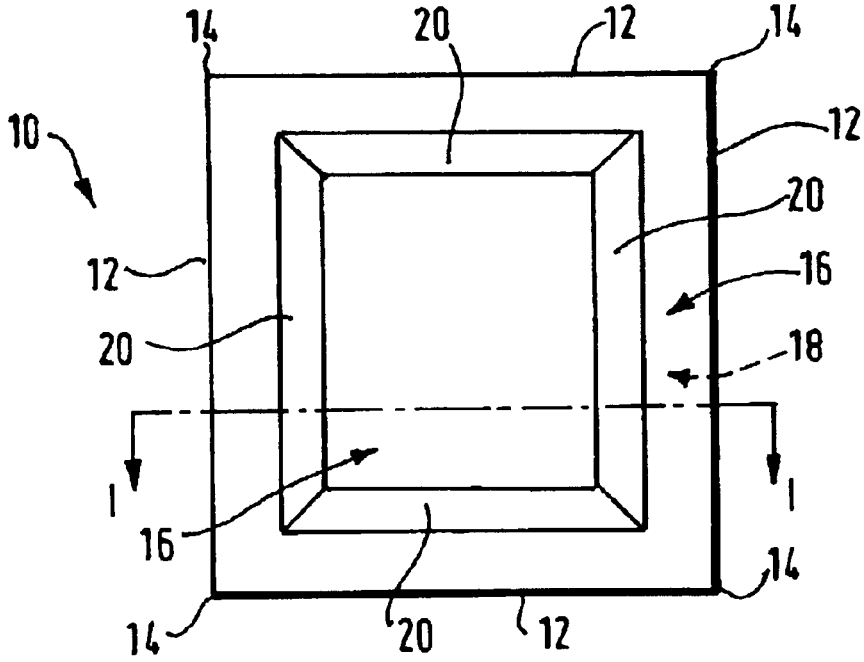
FIG. 2 is a plan view of the appearance surface of the substrate of FIG. 1.

As used herein, a coating powder means a solid, particulate film-forming composition, whereas a powder coating means the film formed on a substrate by curing a coating powder. Coating powders usually comprise a solid, thermoplastic or thermosetting film-forming polymer resin. A number of different types thermoplastic resins for coating powders are known, for example vinyl chloride, polyamides, celluloses, polyolefins, polyethylene, and polyesters. Thermosetting film-forming resins contain reactive functional groups, an optional curing agent (crosslinking agent) having functional groups reactive with the functional groups of the polymer resin, and which may itself be another film-forming polymer, and an optional catalyst. Known thermosetting resins include but are not limited to acid-functional polyester resins, acid-functional acrylic resins, epoxy resins, and hydroxy-functional polyester resins.

Preferred polymer resins are low temperature cure thermosetting resins suitable for use with heat-sensitive substrates such as wood, fiberboard, and some plastics. Low temperature cure compositions generally cure at temperatures less than 325° F. (163° C.), preferably less than 300° F. (149° C.), most preferably less than 275° F. (135° C.). Cure is also generally greater than about 100° F. (39° C.), more preferably greater than 200° F. (93° C.) to provide storage and processing stability. Examples of a suitable coating powder composition capable of cure at low temperatures include systems comprising an acid functional polymer such as carboxylic acid functional polyester or a carboxylic acid functional acrylic resin, a polyepoxy compound, and an optional catalyst; an epoxy thermosetting resin, and an optional catalyst; and a GMA resin, a difunctional carboxylic acid curing agent, a catalyst, and optionally 1 to 10 parts per hundred parts of resin of a matte texturizing agent, for example polytetrafluoroethylene (PTFE), or mixtures of PTFE and low melting waxes such as paraffin.

The application of coatings to both the appearance surfaces and the non-appearance surfaces of a substrate allows a balance to be achieved across opposing sides of the substrate. This balance allows for the substantially uniform penetration of moisture into the substrate and the substantially uniform out-gassing of volatile organic compounds (VOCs) from the substrate. With uniform moisture penetration and out-gassing of volatiles from each side of the substrate, the differential expansion of the substrate is controlled and minimized, thereby reducing the possibility that the substrate will warp and stress the coatings. In avoiding or reducing stresses placed on the coatings, the amount and severity of surface defects is substantially reduced.

Although the disclosure below is described in relation to a substrate fabricated from fiberboard, the substrate may be fabricated from other materials, including, but not limited to, other lignocellulosic materials (e.g., both hard and soft woods) and plastics. The substrate is shaped to have an appearance surface (a surface that is generally visible) and a non-appearance surface (a surface that is generally not visible). The appearance surface may be decoratively configured, e.g., routed or otherwise machined to include a design. The non-appearance surface is generally not decoratively configured but is oftentimes routed or otherwise machined to include means by which gas and moisture may escape from the core of the substrate. Examples of substrates having appearance surfaces and non-appearance surfaces include those that are formable into cabinet doors, tabletops, flooring materials (e.g., wood flooring and vinyl flooring), and trim moldings.

The fiberboard from which the substrate is fabricated is generally of a medium density and comprises wood fibers and wood particles mixed with a binding resin. The mixture is then hot-pressed to the general shape of the finished product. The fiberboard is then cured to enable the resin to set, thereby allowing the fiberboard to retain its shape and giving the substrate its structural integrity. Moisture content of the fiberboard at this point is about 5% to about 7% on a weight/weight basis. Once cured, the fiberboard can be machined to include the desired aesthetic configurations, as well as functional openings and channels that allow for the out-gassing of VOCs from inner regions of the fiberboard. Subsequent to the machining process, the fiberboard is coated with the coating to effectively control (or prevent) the transfer of moisture between the fiberboard material and the adjacent environment.

Powder coatings are generally sprayed to achieve coating thicknesses of 0.0254 millimeters (mm) to 0.102 mm in a single application. In contrast, it should be noted that two coats of liquid paint typically provide a coating having a thickness of less than 0.0254 mm. Powder coatings are furthermore environmentally friendly alternatives to solvent-based paints (which contain VOCs that are released into the atmosphere) and platings (which generate waste solutions).

In the case of a spray application of a powder coating, because the wood is substantially electrically non-conductive, the surface thereof is artificially made conductive to effect the electrostatic adherence of the powder. One exemplary method of making the surface artificially conductive involves wetting the surface, preferably by heating the wood. Wood (as well as other materials from which the substrate can be fabricated) is generally heat sensitive, and, therefore, heating temperatures are generally less than about 165° C. Heating drives moisture to the surfaces of the wood and facilitates the formation of a thin water layer at the surfaces. The thin water layer imparts a conductivity to the wood to enable the powder coating, which is statically charged, to adhere to the surfaces. The temperature to which the wood is heated is, furthermore, generally sufficient to fuse the particles of the powder to each other, thereby enabling the powder to form a coating that is substantially free from aberrations and variations in thickness. The coating is then optionally cured by heat, ultraviolet light, or a combination thereof.

Referring now to FIG. 1, an exemplary embodiment of a substrate is shown at 10. Substrate 10 comprises a substantially planar element defined by edges 12, corners 14, an appearance surface, shown generally at 16, and a non-appearance surface, shown generally at 18, disposed opposite appearance surface 16. As indicated above, substrate 10 is formed of a lignocellulosic material, such as fiberboard. Discontinuities in surfaces 16, 18 characterized by grooves, channels, holes, or similar configurations allow varying degrees of expansion and contraction to be realized within substrate 10 upon the transfer of moisture across the substrate boundaries.

Figure 3:
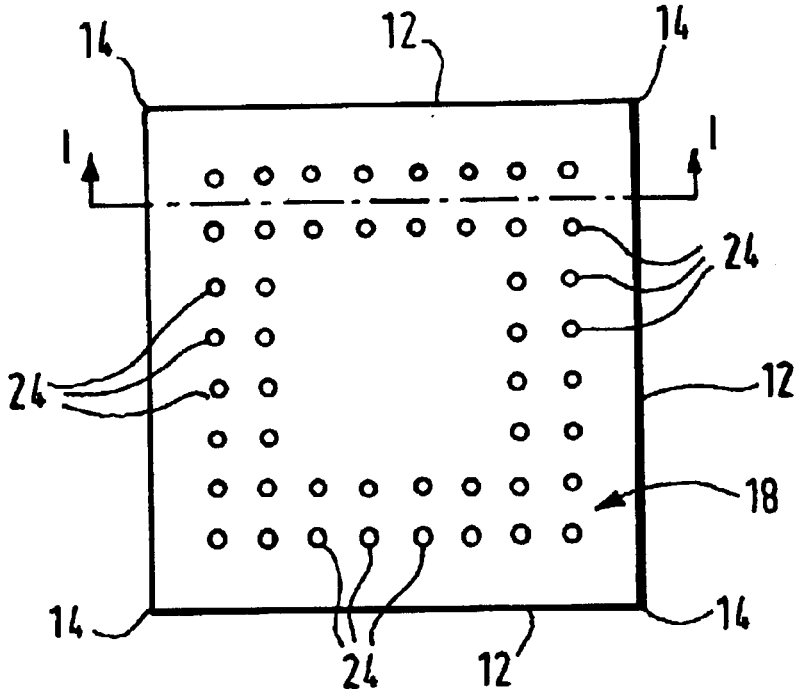
FIG. 3 is a plan view of the non-appearance surface of the substrate of FIG. 1.

Appearance surface 16 is routed, cut, machined, drilled, stamped, or otherwise formed to define an aesthetic pattern. Although the formed pattern can be of any configuration, it is generally a grooved surface, as is shown at 20 and is hereinafter referred to as "groove 20." An appearance coating 22 is disposed over appearance surface 16. Non-appearance surface 18 may optionally be similarly formed to define a pattern. Such a pattern is generally less design-oriented and aesthetically pleasing than that disposed at appearance surface 16 and is configured to provide for the out-gassing of volatiles from core portions of substrate 10 due to the aging of the resin utilized to bind the wood fibers. Discontinuities formed in non-appearance surface 18 are generally holes, as are shown at 24 with reference to FIG. 3, that correspond in position to groove 20 disposed at the opposing appearance surface 16. A non-appearance coating 26 is disposed over non-appearance surface 18.

To limit the amount of expansion experienced by substrate 10, thereby providing adequate stress relief to coatings 22, 26, grooves 20 and holes 24 are dimensioned and positioned at predetermined areas of their respective surfaces 16, 18. Specific dimensions of holes 24 and their locations at non-appearance surface 18 are dependent upon various parameters. Such parameters include, but are not limited to, the nature of substrate 10 (e.g., density, moisture content, types of binding resin, type of wood, substrate density profile, and the like), the configuration of grooves 20 (e.g., depth and width), the type and composition of the coating powder, and processing parameters (e.g., temperature and times required to effect curing of the binding resin and curing of the coating powder).

With regard to the substrate density profile, medium-density fiberboard is generally substantially denser proximate the exposed surfaces than at regions proximate to the core of the board. Similar characteristics apply to high-density fiberboard. Although such a density profile occurs naturally in fiberboard formed by compressing fibers bound with a resin, the imposition of an aesthetic design effected by placement of groove 20 at appearance surface 16 may alter the density profile. In particular, during the cutting of groove 20, outer layers 28 of substrate 10 proximate surfaces 16, 18 are removed to expose the less-dense layers, shown at 30 with reference to FIG. 1, proximate the core region of substrate 10. In such fiberboard, the denser outer layers 28, which would provide a barrier to the out-gassing of the volatile materials of the binding resin, cause escaping volatiles to travel lateral paths to the machined edges of groove 20 and the peripheral edges of substrate 10. Travel of the volatiles along lateral paths generally causes the majority of the volatile material to be out-gassed at edges 12 of substrate 10.

Prior to coatings 22, 26 being applied, the fiberboard experiences one heating and cooling cycle in which the wood fibers are bound in the resin and cured and a second heating and cooling cycle in which moisture is driven to the surfaces of substrate 10. As moisture is driven from substrate 10, the fiberboard becomes increasingly hygroscopic. Upon completion of the heating and cooling cycles, the fiberboard has been dried such that a contraction of the material may occur. In order to seal the fiberboard to prevent absorption of water from the adjacent atmosphere, coatings 22, 26 are applied to both surfaces 16, 18. By preventing the absorption of water into the fiberboard, substrate 10 is less likely to expand and cause substrate 10 to warp, which may interrupt the continuity of coatings 22, 26.

Coatings 22, 26, as stated above, are preferably applied and electrostatically adhered to both appearance surface 16 and non-appearance surface 18, respectively, to provide the moisture barriers. Various other manners in which coatings 22, 26 may be deposited onto substrate 10 include, but are not limited to, vapor deposition, screen printing, and through the disposal of substrate 10 into a fluidized bed. For non-powder coatings or powder coatings suspended in aqueous or solvent mediums, the fiberboard can be dipped or brushed with the coating material.

Figure 4:
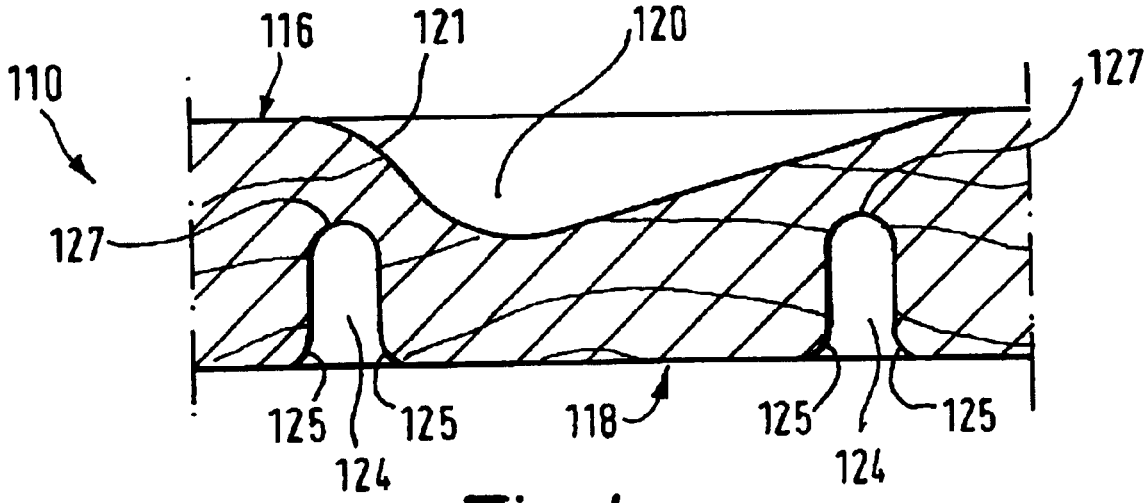
FIG. 4 is a sectional view of a substrate having rounded surfaces disposed at the junctures of discontinuities in the surfaces and adjacently positioned surfaces.

In another exemplary embodiment of a substrate shown at 110 with reference to FIG. 4, edges 121 defined by the juncture of grooves 120 with an adjacent surface at an appearance surface, shown generally at 116, are rounded in order to facilitate the adherence of the coating (not shown) to substrate 110 at edges 121. Furthermore, edges 125 defined by the junctures of holes 124 with a non-appearance face, shown generally at 118, are likewise rounded. Moreover, terminus surfaces 127 of holes 124 may also be rounded. By replacing sharp edges with rounded surfaces, excess material of which substrate 110 is fabricated is removed, thereby allowing shorter and more uniform temperature profiles to be realized across substrate 110 extending from the core regions of substrate 110 to the surfaces of coatings disposed thereon. Uniformity of temperature profiles allows for more uniform cooling of substrate 110 during cooling cycles, which in turn provides for less disparity in the times required for the curing of the coating at different parts of the same substrate 110.

The following examples further describe the above-mentioned inventive method.

What is claimed is:

1. A method of coating a substrate having an appearance surface and a non-appearance surface, the method comprising:

routing or machining the appearance surface of the substrate to include a rout or design;

machining the non-appearance surface of the substrate;

disposing a first coating powder at the appearance surface of the substrate; and disposing a second coating powder at the non-appearance surface of the substrate, wherein the said rout or design forms a rounded juncture of the said rout or design with the said appearance surface.

2. The method of claim 1, wherein the machining of the appearance surface comprises routing, cutting, drilling, or stamping the appearance surface to include a first discontinuity therein.

3. The method of claim 1, further comprising fusing, and optionally curing the coating powder to form a powder coating.

4. The method of claim 1, wherein the machining of the non-appearance surface comprises routing, cutting, drilling, or stamping the non-appearance surface to include a second discontinuity therein.

5. The method of claim 4, further comprising rounding an edge at a juncture of the second discontinuity and a surface adjacent to the second discontinuity.

6. A method of reducing the formation of surface defects in a coated substrate, the method comprising:

applying a first powder coating to an appearance surface of the substrate; and applying a second powder coating to a non-appearance surface of the substrate, wherein, the appearance surface of the substrate is routed to include a rout or is machined to include a design, and, further wherein, the said rout or design forms a rounded juncture of said rout or said design with said appearance surface.

7. The method of claim 6, further comprising heating the substrate.

8. The method of claim 6, wherein the non-appearance surface of the substrate is machined.

9. The method of claim 6, where the applying of the first powder coating comprises, disposing a first coating powder at the appearance surface of the substrate, and fusing the first coating powder.

10. The method of claim 9, further comprising curing the first coating powder.

* * * * *